US008539697B2

(12) United States Patent
Healy et al.

(10) Patent No.: US 8,539,697 B2
(45) Date of Patent: Sep. 24, 2013

(54) SUSPENSION HEEL

(75) Inventors: John Healy, Madbury, NH (US); Peter Dillon, Topsfield, MA (US); Christopher Adam, Newburyport, MA (US)

(73) Assignee: TBL Licensing LLC, Wilmington, DE (US)

( * ) Notice: Subject to any disclaimer, the term of this patent is extended or adjusted under 35 U.S.C. 154(b) by 0 days.

(21) Appl. No.: 13/269,134

(22) Filed: Oct. 7, 2011

(65) Prior Publication Data

US 2012/0085002 A1 Apr. 12, 2012

Related U.S. Application Data

(63) Continuation-in-part of application No. 29/376,693, filed on Oct. 11, 2010, now Pat. No. Des. 666,402.

(60) Provisional application No. 61/391,797, filed on Oct. 11, 2010.

(51) Int. Cl.

| | |
|---|---|
| ***A43B 13/18*** | (2006.01) |
| ***A43B 21/26*** | (2006.01) |
| ***A43B 21/54*** | (2006.01) |

(52) U.S. Cl.

USPC ..... 36/34 R; 36/103; 36/36 R

(58) Field of Classification Search

USPC ..... 36/36 B, 36 R, 42, 34 R, 25 R, 103, 36/100; 12/142 R, 147 R, 146 B

See application file for complete search history.

(56) References Cited

U.S. PATENT DOCUMENTS

| | | | | | |
|---|---|---|---|---|---|
| D99,700 | S | | 5/1936 | Calderazzo | |
| D110,122 | S | | 6/1938 | Lipp | |
| 2,126,669 | A | | 8/1938 | Ryberg | |
| D119,486 | S | | 3/1940 | Cohen | |
| 2,212,263 | A | | 8/1940 | Convy | |
| 2,288,388 | A | | 6/1942 | Bolten et al. | |
| 2,328,319 | A | | 8/1943 | Barton et al. | |
| 2,364,744 | A | | 12/1944 | Morris | |
| 2,508,318 | A | * | 5/1950 | Wallach | 36/38 |
| 2,934,840 | A | | 5/1960 | Mistarz et al. | |
| D201,863 | S | | 8/1965 | Goldberg | |
| 3,822,490 | A | * | 7/1974 | Murawski | 36/105 |

(Continued)

FOREIGN PATENT DOCUMENTS

KR 20-1993-0000117 1/1993

OTHER PUBLICATIONS

International Search Report and Written Opinion for PCT/US2011/055762 mailed May 11, 2012.

*Primary Examiner* — Jila M Mohandesi

(74) *Attorney, Agent, or Firm* — Lerner, David, Littenberg, Krumholz & Mentlik, LLP

(57) ABSTRACT

A suspension heel is provided for use with footwear, such as high heeled shoes, to provide cushioning to the wearer. The suspension heel includes a heel shaft connected to the shoe sole and a compliant heel plug attached to the heel shaft. The shaft includes a cavity or other receptacle for receiving the compliant heel plug. The suspension heel provides cushioning as well as stability for the wearer of the footwear, while maintaining aesthetic style. A relief detail formed by the compliant heel plug and the shaft provides compliance by compressing when a force is applied. For instance, as a person walks in the shoe, ground contact applies a force to the suspension heel. The relief detail deforms or compresses in response to the force, attenuating it and providing cushioning to the wearer.

22 Claims, 22 Drawing Sheets

(56) References Cited

U.S. PATENT DOCUMENTS

| | | | | |
|---|---|---|---|---|
| D258,549 | S | 3/1981 | Goldman | |
| D258,620 | S | 3/1981 | Goldman | |
| D258,621 | S | 3/1981 | Goldman | |
| D347,937 | S | 6/1994 | Garland | |
| 6,021,586 | A * | 2/2000 | Bucalo et al. | 36/42 |
| 6,406,038 | B2 * | 6/2002 | Adams | 280/11.24 |
| 6,711,835 | B1 * | 3/2004 | Militello | 36/42 |
| 6,746,026 | B2 * | 6/2004 | Adams | 280/11.19 |
| D495,481 | S | 9/2004 | Cohen | |
| 7,059,068 | B2 | 6/2006 | Magallanes et al. | |
| D535,087 | S | 1/2007 | Amado et al. | |
| D563,638 | S | 3/2008 | Guers-Neyrud | |
| D590,143 | S | 4/2009 | Guers-Neyraud | |
| D605,840 | S | 12/2009 | Schwartz | |
| D612,590 | S | 3/2010 | Guers-Neyraud | |
| D631,647 | S | 2/2011 | Hipshman | |
| D632,469 | S | 2/2011 | Guers-Neyrud | |
| D647,291 | S | 10/2011 | Ringholz | |
| D662,297 | S | 6/2012 | Ringholz | |
| D665,980 | S | 8/2012 | Ruano Cerdan et al. | |
| D666,402 | S | 9/2012 | Healy et al. | |
| 2003/0136028 | A1 | 7/2003 | Magallanes et al. | |
| 2006/0101670 | A1 * | 5/2006 | Bucalo | 36/81 |
| 2009/0133291 | A1 | 5/2009 | Frasconi et al. | |
| 2009/0139111 | A1 | 6/2009 | Joseph | |

* cited by examiner

SUSPENSION HEEL

CROSS-REFERENCE TO RELATED APPLICATIONS

This application is a continuation-in-part of U.S. Design application Ser. No. 29/376,693, filed on Oct. 11, 2010, now pending, and claims the benefit of the filing date of U.S. Provisional Patent Application No. 61/391,797 filed Oct. 11, 2010, the entire disclosures of which are hereby incorporated herein by reference.

BACKGROUND OF THE INVENTION

1. Field of the Invention

The present invention relates generally to footwear. More particularly, the present invention relates to a suspension system that supplies enhanced cushioning in high heeled footwear.

2. Description of Related Art

High heels are a very popular footwear choice due to their elegant style and increase in virtual height of the wearer. However, certain challenges relating to high-heeled footwear exist for both the consumer and manufacturer. Despite their popularity, high-heeled shoes require a certain set of skills to wear effectively without losing stability or falling down. Moreover, there typically is a loss of comfort as compared with flat-soled shoes. For instance, the foot is positioned at an awkward angle for sustained periods of time with the toes pointed in a plantarflexion position.

The shock absorbing qualities of such high-heeled footwear can be extremely poor. In the construction of a typical high-heeled shoe, the attachment of the heel component to the sole of the shoe may require a very rigid connection in order to keep the heel component from moving fore and aft or side to side during a normal walking gait. The possibility for such movement is high because of the large lever that the elongated heel creates. With all of the forces focused on the distal end of the heel, a large torque is placed on the point where the heel component meets the shoe sole. A non-rigid connection can quickly deteriorate. In this case, the heel would eventually detach from the shoe sole.

While a rigid connection provides needed durability, it negatively impacts the shoe's ability to cushion the user from the ground. Given that cushioning and protection from the ground are primary functions of footwear, the inclusion of a stiff, high-heeled shoe can detract from one of the fundamental purposes of footwear.

The benefits of style and the increase in virtual height for the wearer are often desirable enough for the user to overlook the discomfort often found in many high heel shoes. However, daily episodes of wearing high-heeled shoes that provide sub-par cushioning can lead to long term disabilities including back injuries, joint discomfort, bunions, heel spurs, and other foot injuries.

SUMMARY OF THE INVENTION

The present invention addresses the disadvantages of conventional high-heeled footwear by providing compliance where the heel meets the ground. This provides much needed cushioning to the wearer. Importantly, this is accomplished while allowing the user to retain beneficial qualities of a high-heeled shoe such as style, a rigid connection between the heel and sole, and stability.

As will be explained in more detail below, aspects of the invention provide for this compliance through a combination of features. Compliance in the vertical direction, in order to provide cushioning, absorbs the ground reaction force by straining a compliant material. Compliance is further created via a rolling action in the gait and increased surface area contact between a compliant heel plug and the ground. The rolling action as the wearer walks helps to distribute contact forces and keeps those forces from transmitting up through the heel of the shoe and into the wearer's body.

An article of footwear, comprising a sole, an upper and a suspension heel member. The sole has a first surface for supporting a wearer's foot and a second surface remote from the first surface. The upper connected to the sole. And the suspension heel member includes a heel shaft having a first end connected to the second surface of the sole, and a second distal end remote from the first end. The distal end of the heel shaft has a heel cavity therein. The suspension heel member also includes a compliant heel plug having a base section for contacting the ground and a connecting section attached to the base section and being adapted to fit within the cavity of the distal end of the heel shaft. The compliant heel plug and the distal end of the heel shaft form a relief detail for providing force attenuation to the wearer.

In one example, the base section of the compliant heel plug includes anterior and posterior regions, and the posterior region includes a curved surface with a predefined radius for providing a rolling action when contacting the ground during use of the article of footwear.

Attenuating the amount of force transmitted through an article of footwear by providing an article of footwear with a sole, an upper connected to a first surface of the sole, and a suspension heel, having a heel shaft and a compliant heel plug rigidly affixed to interior sidewalls of a cavity in the heel shaft, connected to a second surface of the sole. Flexing a base section and a partially exposed connecting section of the compliant heel plug upon application of force to the upper or the compliant heel plug. Decreasing the contact forces transmitted through the article of footwear that are created when the compliant heel plug strikes a surface, in comparison to a traditional heel, by providing a curved posterior section of the compliant heel plug to create a greater contact surface area and a rolling action.

The features shown in the figures are not drawn to scale.

DETAILED DESCRIPTION

In describing preferred embodiments of the invention illustrated in the appended drawings, specific terminology will be used for the sake of clarity. However, the invention is not intended to be limited to the specific terms used, and it is to be understood that each specific term includes all technical equivalents that operate in a similar manner to accomplish a similar purpose. While the illustrated embodiments present a suspension heel architecture that is desirably used in a high-heeled shoe, one skilled in the art would recognize that aspects of the invention may be employed with other types of footwear including, but not limited to, low-heeled shoes or boots.

Figure 1A:
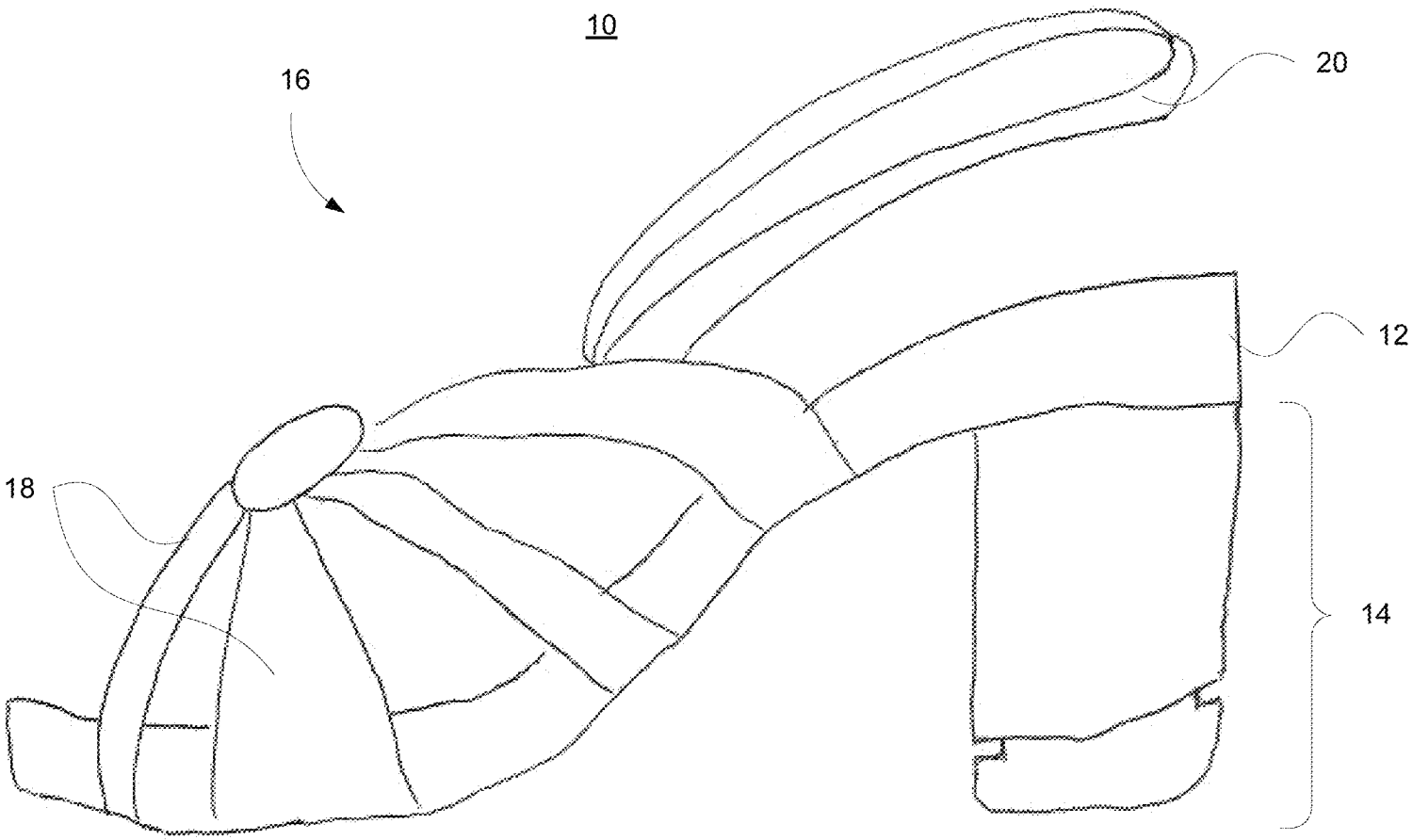
FIGS. 1A-C illustrates views of a high-heeled shoe in accordance with aspects of the invention.
Figure 1B:
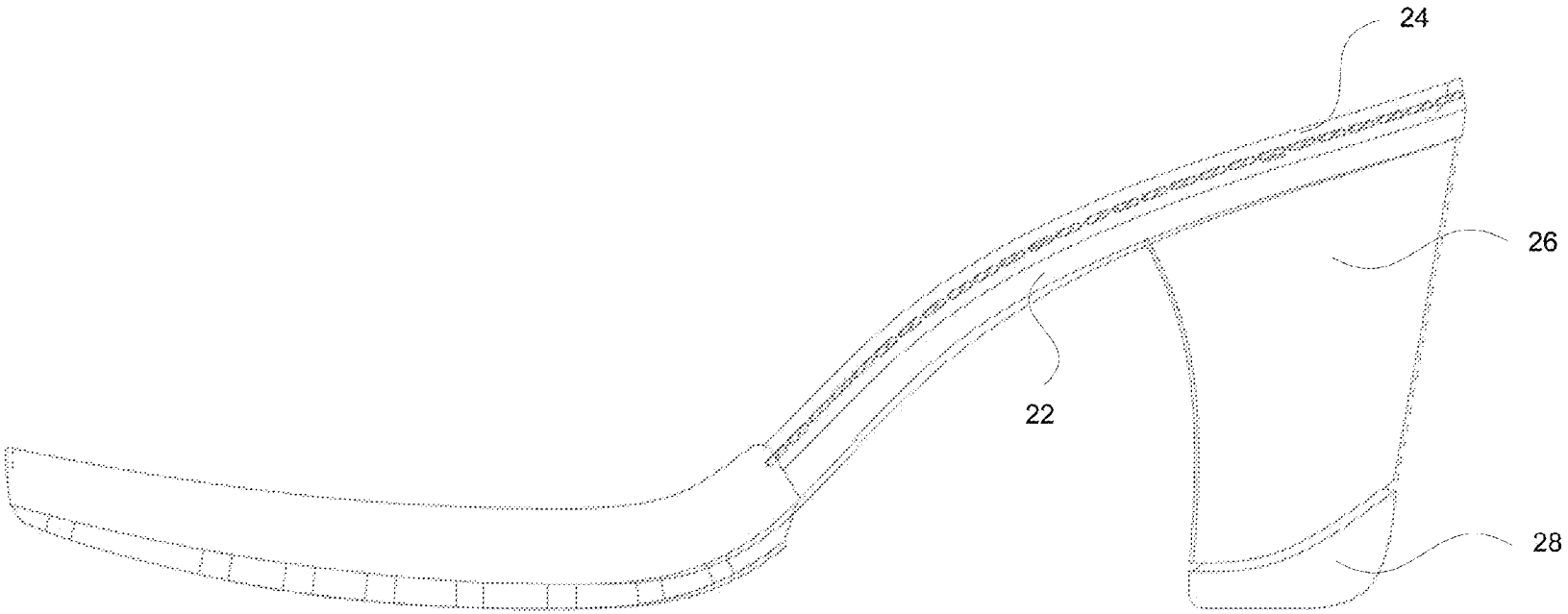
Figure 1C:
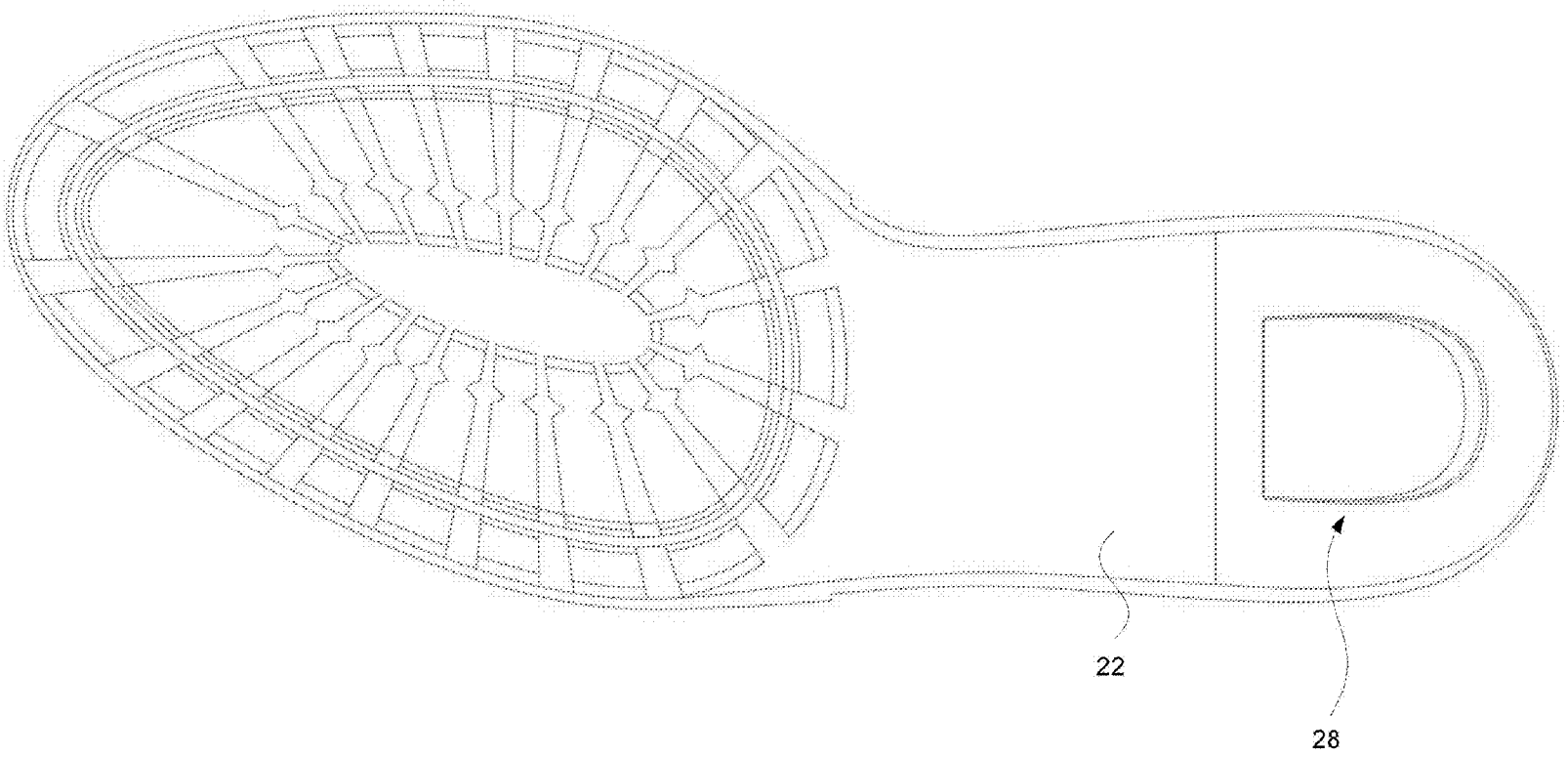

FIGS. 1A-B are side views illustrate an article of footwear 10 that utilizes a suspension heel architecture according to aspects of the invention. FIG. 1C is a bottom view of the article of footwear 10. The article of footwear 10 includes a sole 12, heel member 14 and upper 16. The upper 16 is omitted in the illustration of FIG. 1B. The upper 16 of FIG. 1A presents an open-toe configuration, although those skilled in the art would recognize that other embodiments, such as closed-toe or boot configurations, may also be employed. Here, the upper 16 may include one or more forefoot straps 18 that connect to the sole 12, and an ankle strap 20 that is secured to one of the forefoot straps 18.

Turning to FIG. 1B, the sole 12 may comprise an outsole 22 and an insole/midsole 24. Outsole 22 and the insole/midsole 24 may comprise any types of conventional soles suitable for use with a high-heeled shoe. The outsole may include a tread pattern in the forefoot region for traction and stability, as illustrated in FIG. 1C. The heel member 14 that forms a suspension heel includes a heel shaft 26 and compliant heel plug 28. Heel shaft 26 may be rigidly secured to the heel portion of outsole 22. For example, the heel may be fastened to the outsole 22 using adhesives, tacks, screws or other fastening means. As will be explained in more detail below, compliant heel plug 28 is firmly affixed to heel shaft 26 while providing cushioning and significantly attenuating the ground reaction force.

The heel shaft 26 can be made from a variety of materials. In one example, the heel shaft 26 is formed with an injection molded ABS-type plastic. Other materials include, but are not limited to, wood (such as hard woods, recycled wood), other rigid materials, and combinations thereof.

The compliant heel plug 28 may also be made from a variety of materials, so long as they are compliant or otherwise elastic-type materials that strain/compress when a force is applied. For instance, injected, compressed and thermoplastic rubbers are all suitable for use as the compliant heel plug 28. The compliant heel plug may also be formed from a composite of materials such as a combination of foam and rubber or foam and plastic.

Figure 2:
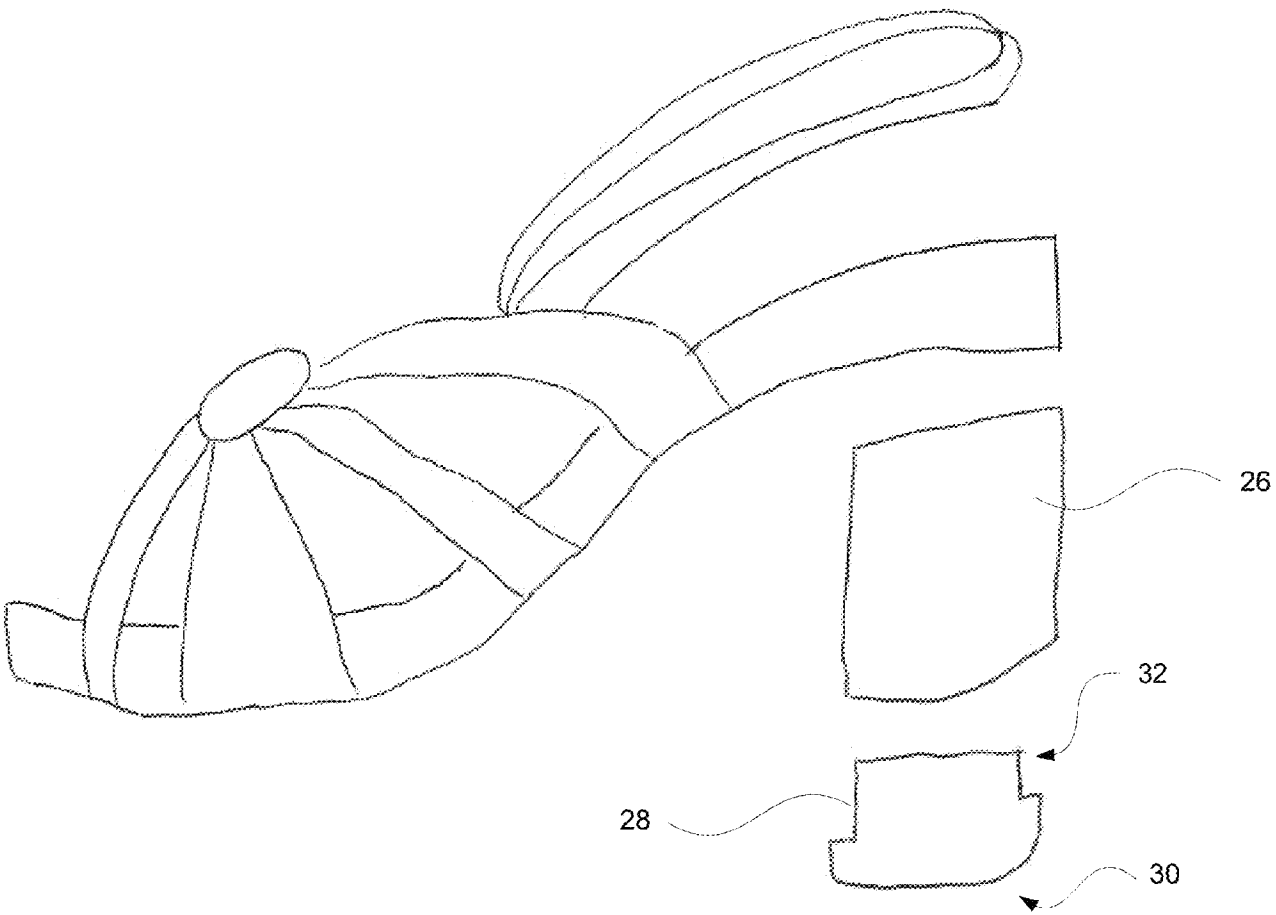
FIG. 2 is an exploded side view that illustrates the elements of the high-heeled shoe of FIG. 1A.
Figure 3:
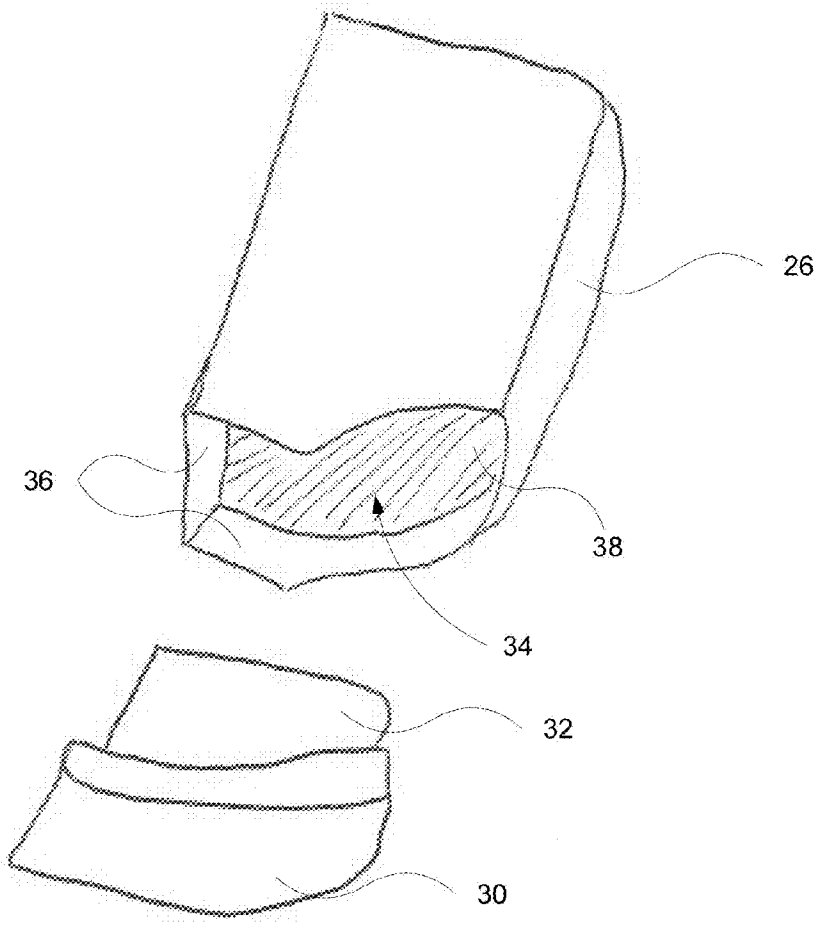
FIG. 3 illustrates a perspective view of a compliant heel plug of FIG. 2 separated from a high heel cavity.

FIG. 2 illustrates an exploded side view of the high-heeled shoe 10 with heel member 14 detached from both outsole 22 and compliant heel plug 28. As shown, the compliant heel plug 28 includes a base section 30 and a connecting section 32. FIG. 3 illustrates an exploded perspective view of the heel shaft 26 separated from the compliant heel plug 28. As shown in this view, the distal end of heel shaft 26 includes a heel cavity 34 for accepting the connecting section 32 of the compliant heel plug 28. Depending on the configuration of the heel shaft 26, the heel cavity 34 may be formed as a molded cavity.

Figure 4A:
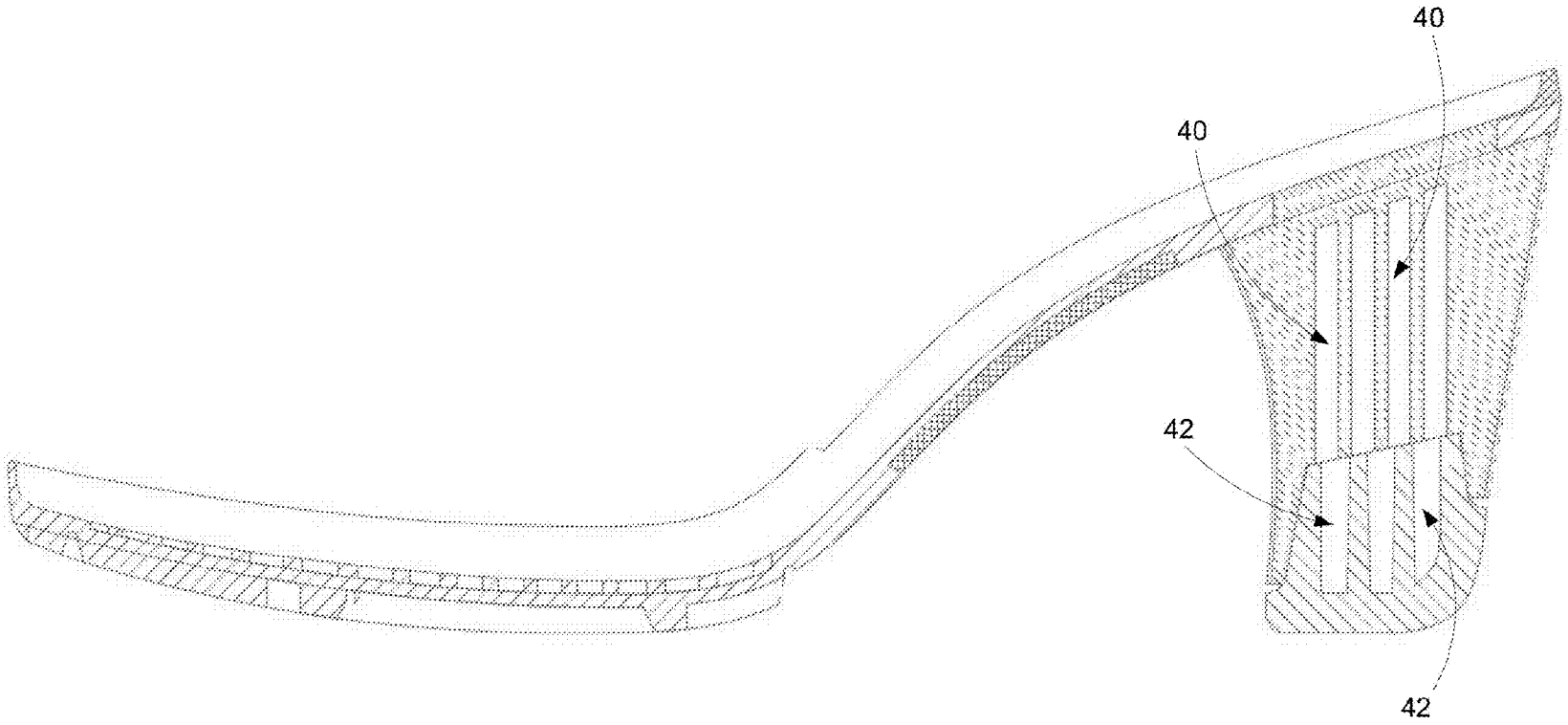
FIGS. 4A-B illustrate cutaway views of a compliant heel plug in accordance with aspects of the invention.
Figure 4B:
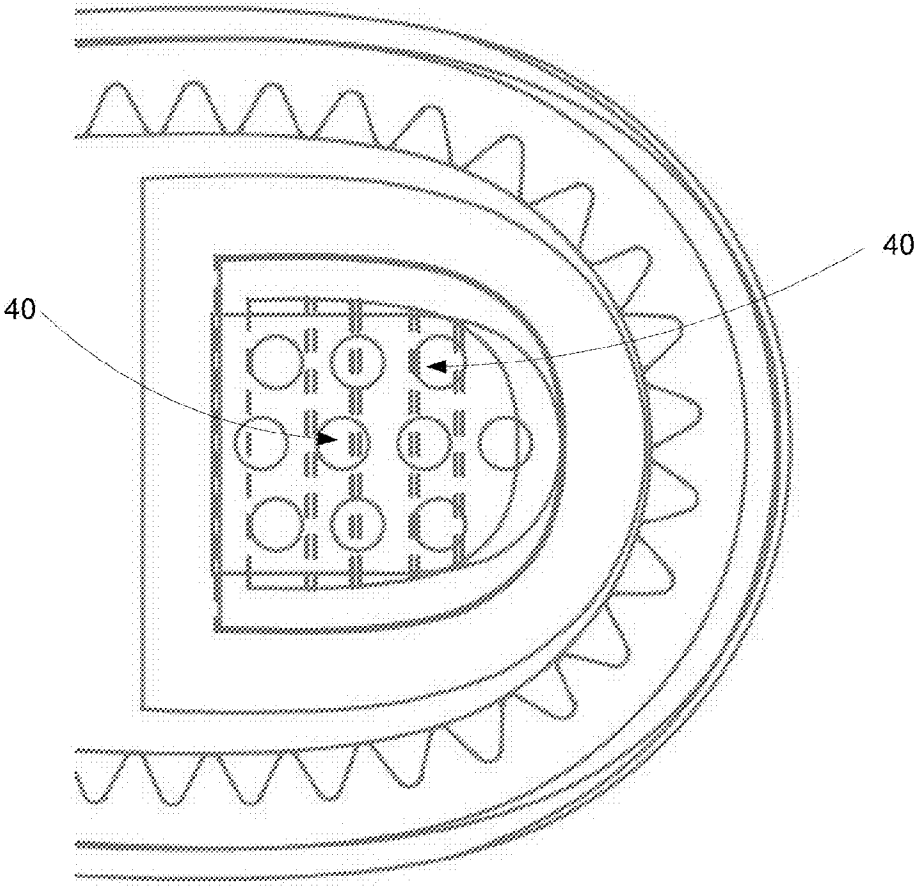

The heel cavity 34 includes interior sidewalls 36 and end surface 38. As shown in the side and top cutaway views of FIGS. 4A and 4B, the heel shaft 26 may include one or more holes or open regions 40. These open regions 40 desirably extend along the shaft to the end surface 38. The diameters of the open regions 40 may be on the order of 5-10 mm, by way of example.

Figure 5:
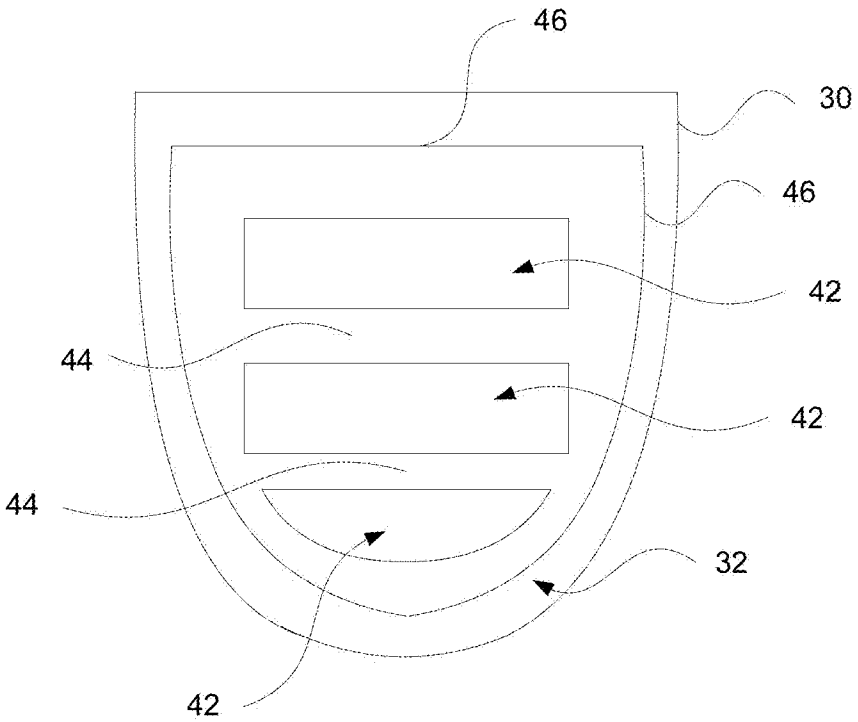
FIG. 5 illustrates a top view of a compliant heel plug in accordance with aspects of the invention.

As shown in FIG. 5, the connecting section 32 of the compliant heel plug 28 may include one or more open regions 42 therealong. The open regions 42 are separated by spacers 44, which desirably extend from an upper surface of the connecting section 32 to the base section 30. The connecting section 32 also includes an exterior surface 46 sized to fit snugly inside receptacle of the heel cavity 34.

Figure 6:
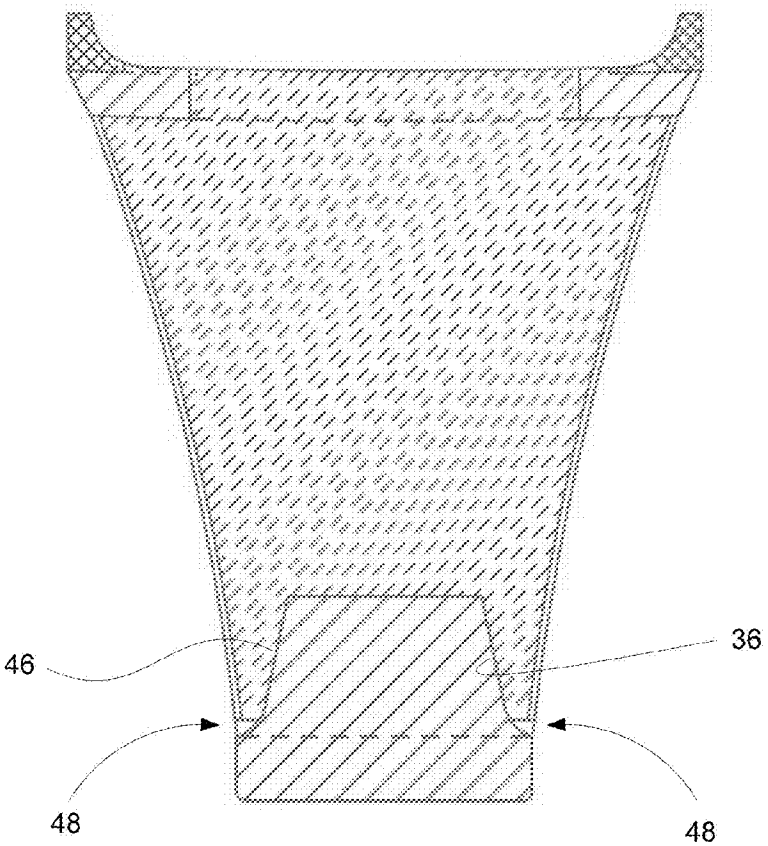
FIG. 6 illustrates is a cutaway view of a suspension heel in accordance with aspects of the invention.

The cutaway view of FIG. 6, taken along the anterior section of the heel member 14, illustrates that, when assembled, the exterior surface 46 of the connecting section 32 adjoins the interior sidewalls 36 of the heel cavity 34. The exterior surface 46 is configured to snugly fit within the interior sidewalls 36. As shown, the exterior surface 46 may narrow or slope (taper) from the base section 30 toward the end surface 38 of the heel cavity 34. This frustoconical or pyramidal-type tapering may be on the order of 1-10 degrees. There is generally a small draft angle of, e.g., 1-5 degrees, to ensure that the part comes out of the mold correctly. Other angles may be used for aesthetic purposes.

The compliant heel plug 28 is desirably affixed to the heel cavity by adhering the exterior surface 46 to the interior sidewalls 36. The upper portions of the spacers 44 may also be adhered to the end surface 38.

As shown in FIG. 6, a relief detail 48 is provided between the base of the heel shaft 26 and the base section 30 of the compliant heel plug 28. The relief detail 48 provides spacing between the base section 30 of the compliant heel plug 28 and heel member 14. The relief detail 48 desirably circumscribes the entirety of the heel member 14. It may be formed due to the tapering configuration of the exterior surface 46 of the connecting section 32. The relief detail 48 allows the lower region of the compliant heel plug 28, such as the base section 30 and the portion of the connecting section exposed by the relief detail 48 to flex and deliver desired force attenuation to the wearer.

Figure 7A:
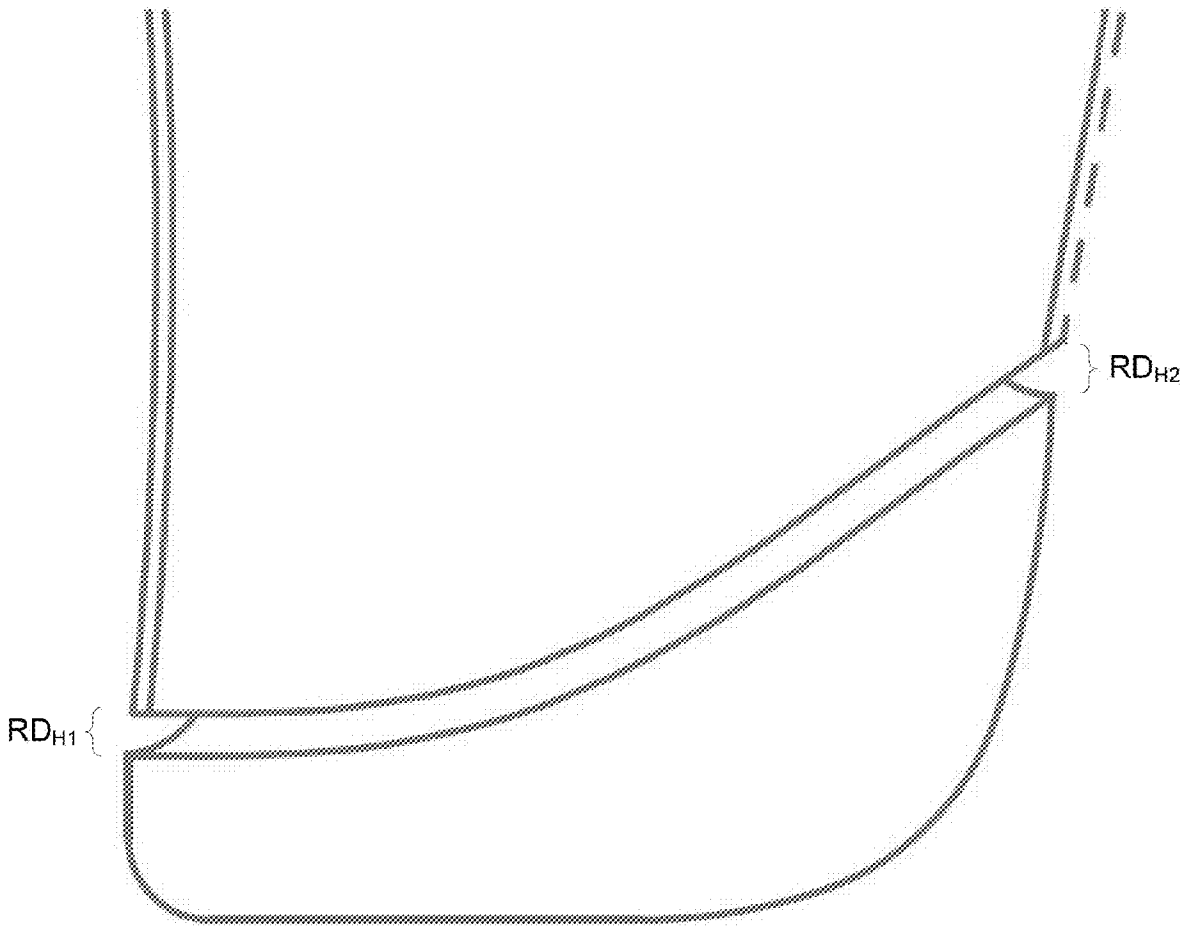
FIGS. 7A-B illustrate a relief detail in unloaded and loaded phases in accordance with aspects of the invention.
Figure 7B:
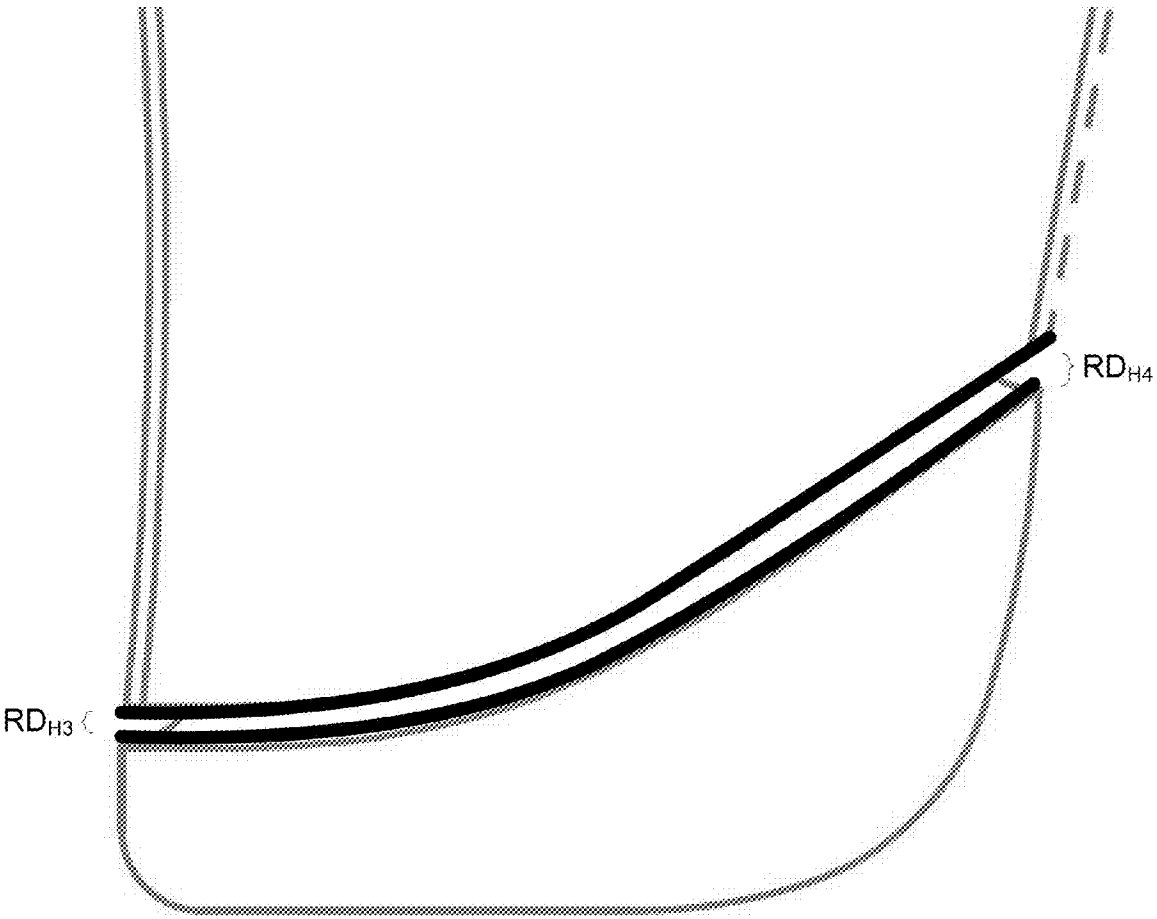

The enlarged views of FIGS. 7A and 7B illustrate how the compliant heel plug 28 provides vertical compliance to the shoe 10. In the scenario of FIG. 7A, assume that the shoe is at rest on the ground without force being applied. In this situation, the relief detail spacing is at its maximum value. Here, the relief detail spacing on the anterior side ($RD_{H1}$) is desirably equivalent to the relief detail spacing on the posterior side ($RD_{H2}$), although this is not required. Similarly, the relief detail spacing along the medial and lateral sides may also be the same size.

In a preferred embodiment, the relief detail spacing in an unloaded or uncompressed state is substantially uniform about the anterior, posterior, medial and lateral regions. In one example, the spacing of the relief detail in an unloaded or uncompressed state is on the order of 5.0 mm. In another example, the spacing of the relief detail in the uncompressed state may be between 3.0-7.0 mm. In a further example, the spacing of the relief detail in the uncompressed state may be at least 1.5 mm. In yet another example, the spacing of the relief detail in the uncompressed state is no more than 10.0 mm.

Figure 7C:
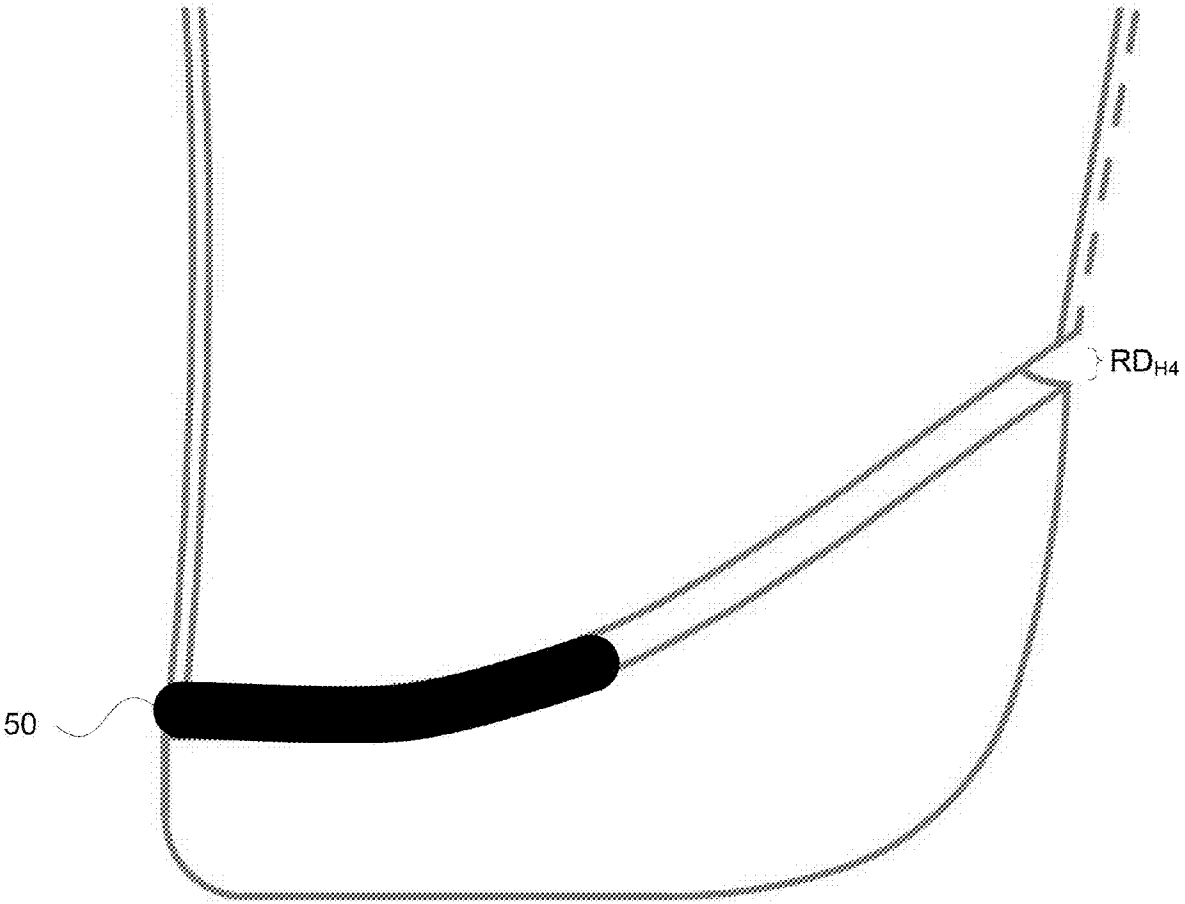
FIGS. 7C-D illustrate alternative relief detail arrangements in accordance with aspects of the invention.
Figure 7D:
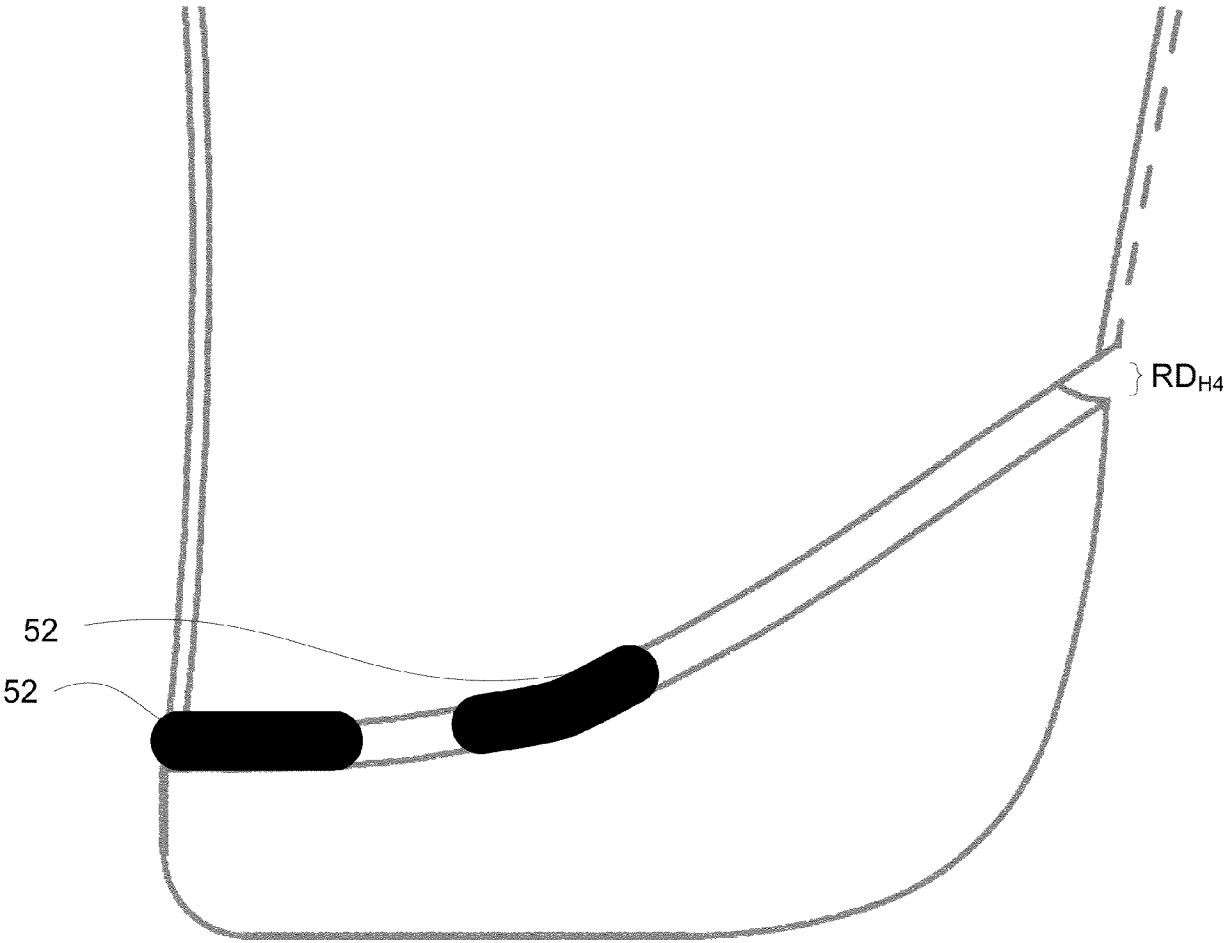

In another embodiment, the relief detail need not fully circumscribe the heel. For instance, one could have the anterior portion flush to or connected with the heel and the other three sides with a relief detail. This would provide cushioning upon heel strike and enhanced stability when the weight of the wearer is evenly distributed across the shoe. This is shown in FIG. 7C, where the heel member 14 includes anterior portion 50 without the relief detail. The anterior portion 50 may be part of compliant heel plug 28, heel shaft 26, or may be part of both components. And FIG. 7D shows a variation that includes multiple anterior portions 52, which also provide the aforementioned benefits.

The particular spacing may vary depending upon the amount of shock attenuation and/or style desired. Larger relief detail spacing would allow for greater vertical compliance than smaller relief detail spacing. In one scenario, the relief detail spacing may vary depending on the type/style of high heeled shoe. For instance, a shoe marketed as the most comfortable high heeled shoe might have a larger relief detail spacing than a shoe that is driven by aesthetics, while still maintaining a threshold level of compliance and shock attenuation at heel strike.

Once a force is applied to the heel member 14, as will occur when the shoe is being worn and the wearer is walking, the heel of the shoe will contact the ground. The compliant heel plug 28 will flex or otherwise partly compress under such a force. Compliance is provided by the relief detail spacing. As the force is applied, the relief detail spacing decreases due to the complaint heel plug 16 flexing. Thus, at least a portion of the ground reaction force is absorbed and the wearer is provided with a degree of cushioning. This can be seen in the example of FIG. 7B, where the relief detail spacing on the anterior side ($RD_{H3}$) is smaller than the relief detail spacing on the anterior side as shown in FIG. 7A ($RD_{H1}$). Similarly, the posterior side relief detail spacing ($RD_{H4}$) in FIG. 7B is smaller than the posterior side relief detail spacing as shown in FIG. 7A ($RD_{H2}$). It should be understood that the medial and lateral relief detail spacing will also be smaller in the case when the heel member is under force than when a force is not applied.

In one example, where the posterior relief detail spacing ($RD_{H2}$) is on the order of 5 mm at its maximum value without force applied in FIG. 7A, the relief detail spacing ($RD_{H4}$) as shown in FIG. 7B may decrease between about 1-2 mm (or 20-40%) to 4-5 mm (or 80-100%) due to force applied. Testing has shown compression on the order of about 1 mm with 50 pounds of force, 3 about mm with 150 pounds of force, and substantially full compression at 200 pounds of force.

The amount of relief detail compression will vary due to the wearer's weight as well as the particular motion of her gait and the material(s) used in the compliant heel plug 28. For example, a greater weight being applied to the shoe may result in higher ranges of compression, while smaller weights may result in smaller ranges of compression for a given embodiment of the invention. Similarly, gaits that produce harder or faster striking of the compliant heel plug 28 against the ground may result in higher ranges of compression, while walking gaits that produce softer or slower striking of the compliant heel plug 28 against the ground may result in lower ranges of compression. The hardness of the walking surface itself may also affect the compression of the relief detail spacing.

Figure 8:
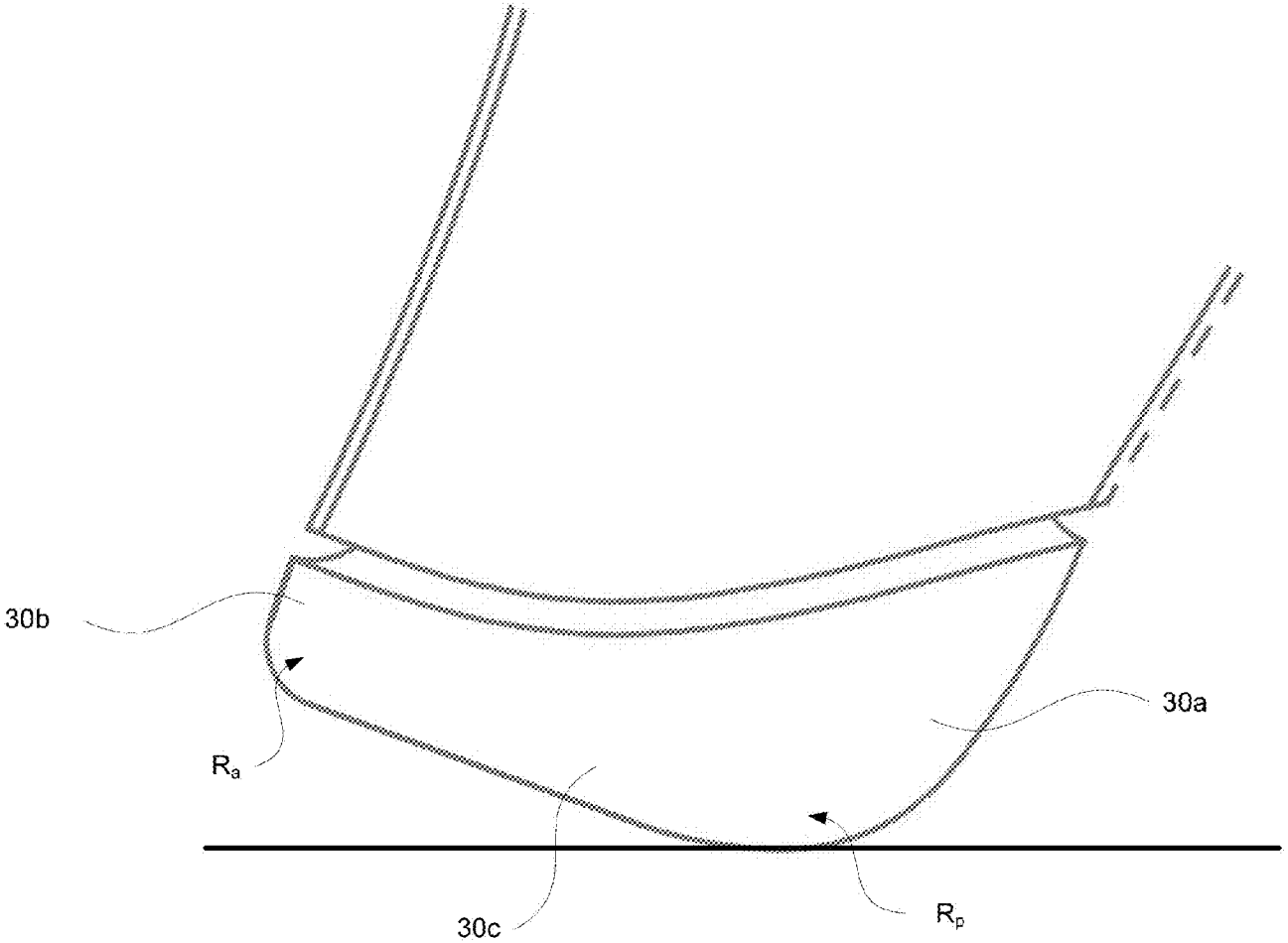
FIG. 8 illustrates aspects of a compliant heel plug in accordance with aspects of the invention.

Furthermore, depending on the point(s) of impact, the force applied to the base section 30 of the compliant heel plug 28 may not be evenly displaced. FIG. 8 illustrates posterior section 30*a* of the compliant heel plug 28 coming into initial contact with the ground during exemplary motion as the wearer is walking in the shoe. In one example, the posterior section 30*a* has a radius $R_p$ on the order of 10 mm. In other examples, the radius $R_p$ may be between 5-15 mm or at least 3 mm. In some alternatives, the radius $R_p$ may be chosen based on aesthetics. In one scenario, the maximum radius $R_p$ ranges from 5-40 mm.

Benefits of radius $R_p$ may be found during heel strike, allowing a more gradual heel strike as compared to a traditional high heel with a straight geometry at the posterior of the heel. The radius $R_p$ provides for a rolling action and increased surface area contact between the base section 30 of the compliant heel plug 28 and the ground, helping to distribute the contact forces and keeping those forces from transmitting up through the heel of the shoe and into the wearer's body. The radius $R_p$ also increases stability and traction due to enhanced ground contact. In one scenario, the medial and lateral portions of the posterior section 30*a* may also be rounded in combination with the radius $R_p$, although it is not required.

As also shown in FIG. 8, anterior region 30*b* of the base section 30 of compliant heel plug 28 may also be rounded, having a radius $R_a$. In one example, the radius $R_a$ may be on the order of 3 mm. In other examples, the radius $R_a$ may be between 1-5 mm, or no greater than 7 mm. As above, there is no requirement for the anterior region to have any radius $R_a$. While not shown in the side view of FIG. 8, any or all of the posterior region 30*a*, anterior region 30*b* and central region 30*c* may include a tread pattern for enhancing contact with the ground.

As indicated above, it can be seen in FIG. 8 that the posterior region 30*a* typically contacts the ground before the anterior region 30*b*. The impact forces are thus initially applied primarily to the posterior region 30*a*. Thus, in one scenario, the compression of posterior relief detail spacing $RD_{H4}$ may be greater than the anterior relief detail spacing $RD_{H3}$.

Figure 9A:
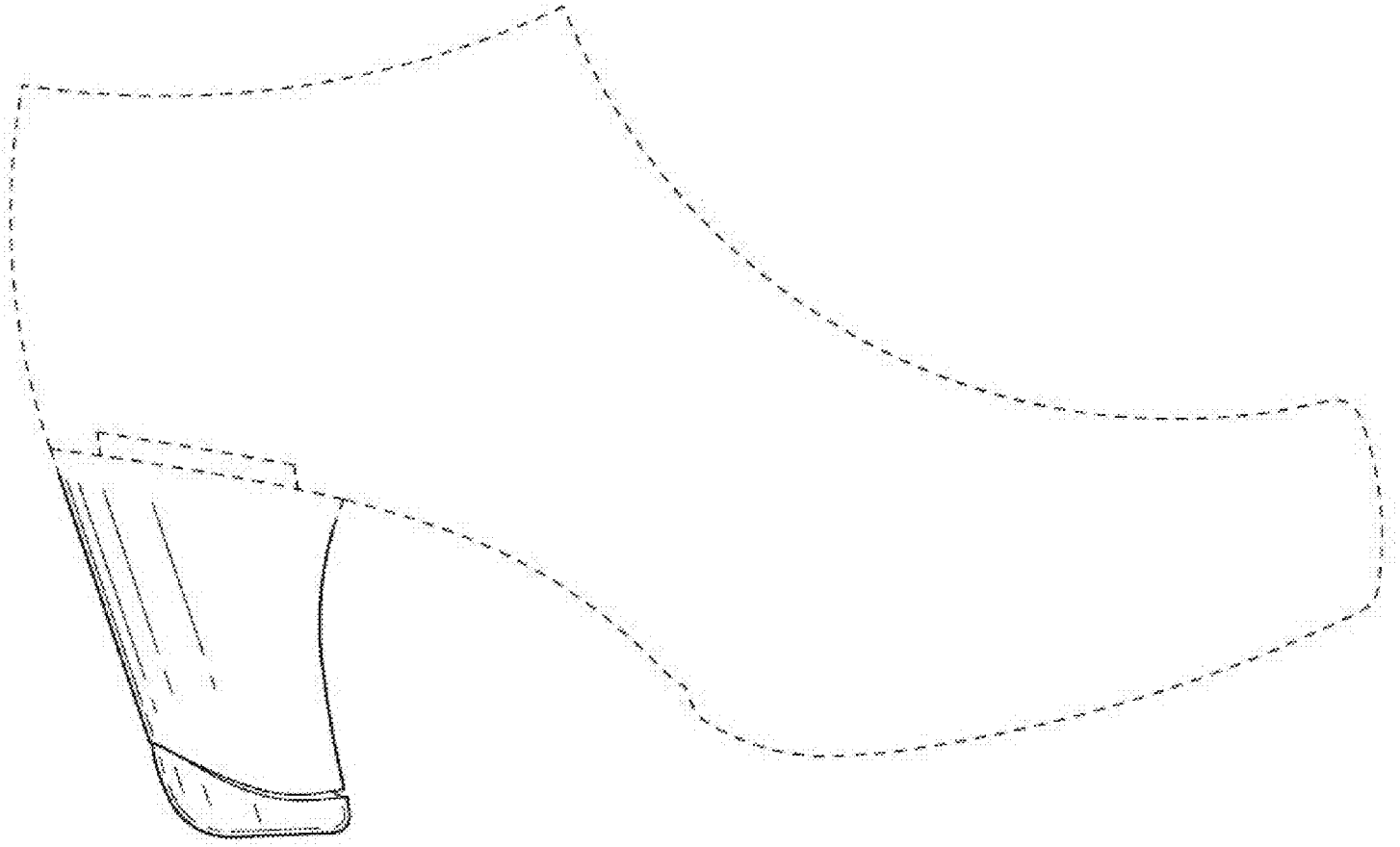
FIGS. 9A-B illustrate compression of relief detail spacing in accordance with aspects of the invention.
Figure 9B:
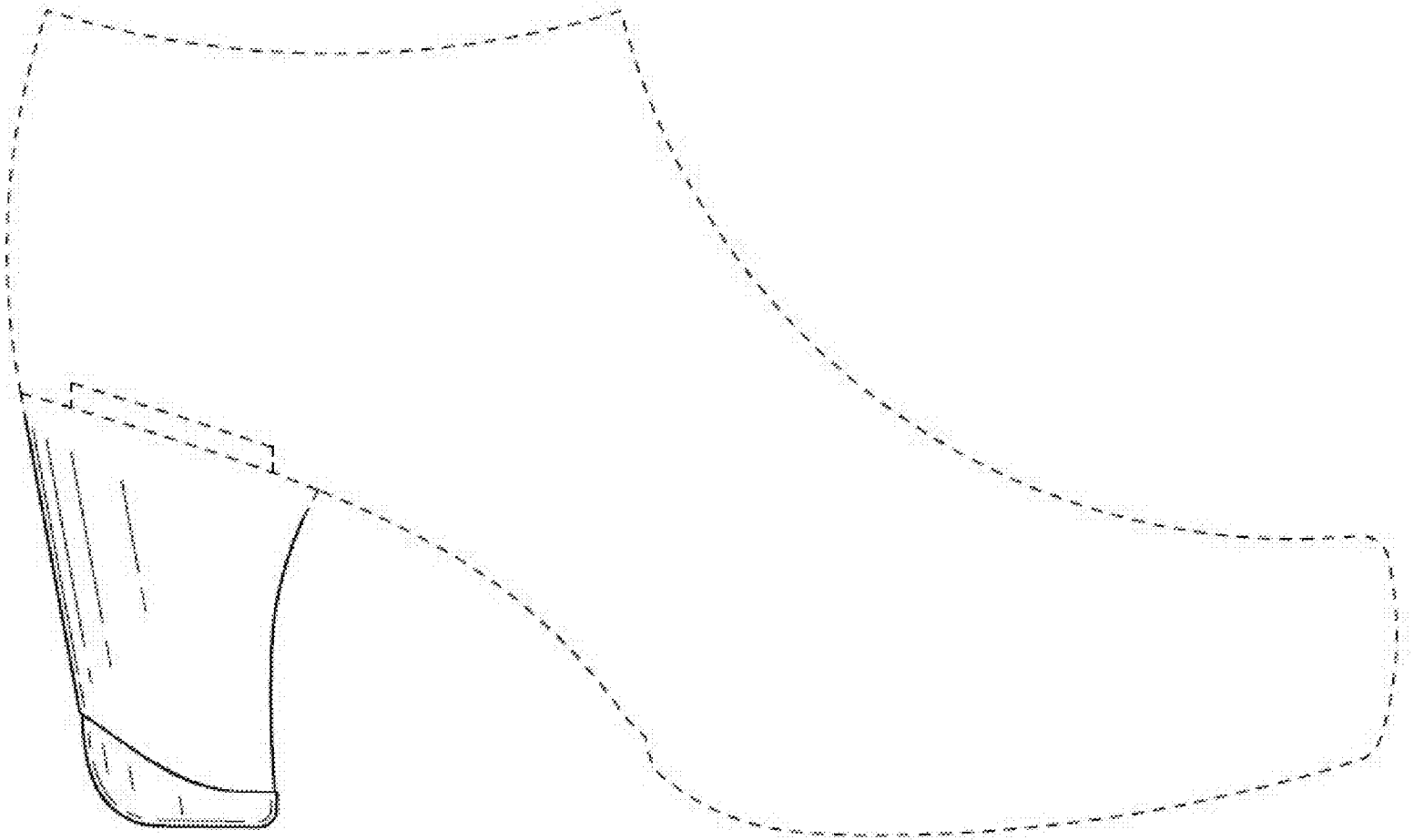
Figure 10A:
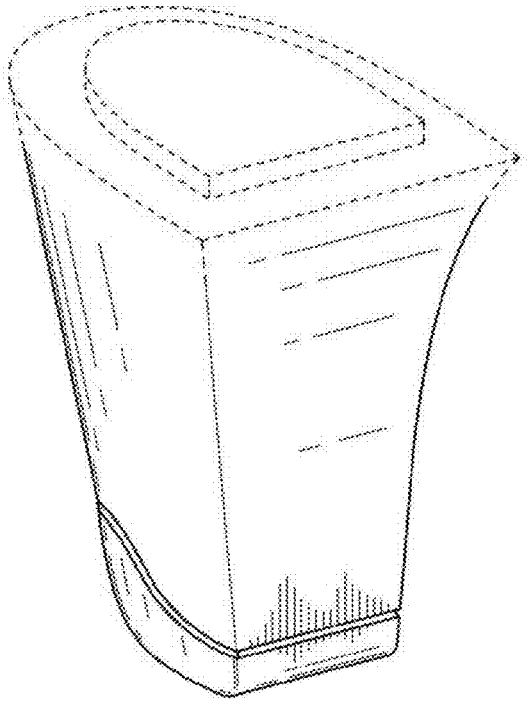
FIGS. 10A-E illustrate different views of one embodiment of the suspension heel in accordance with aspects of the invention.
Figure 10B:
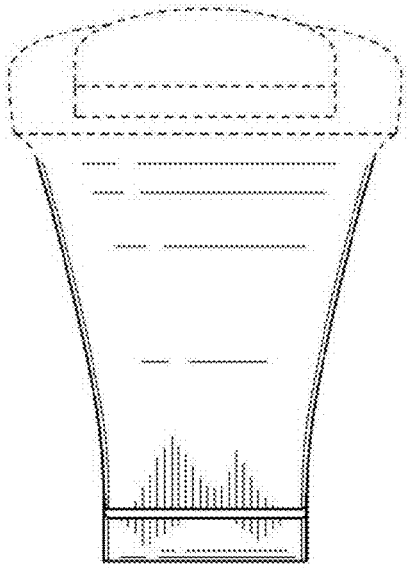
Figure 10C:
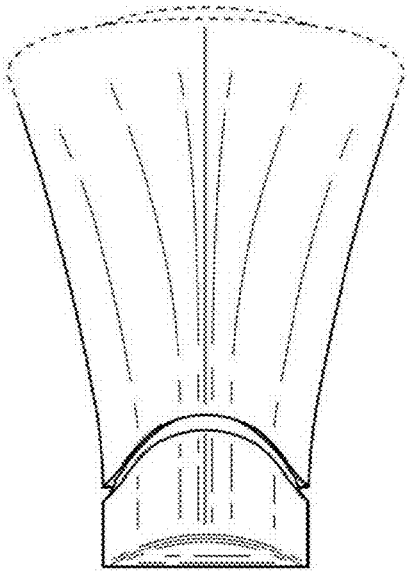
Figure 10D:
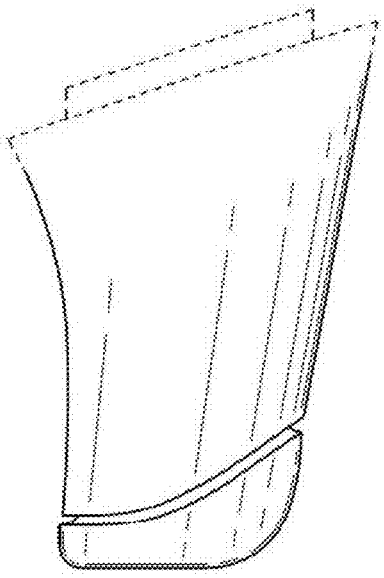
Figure 10E:
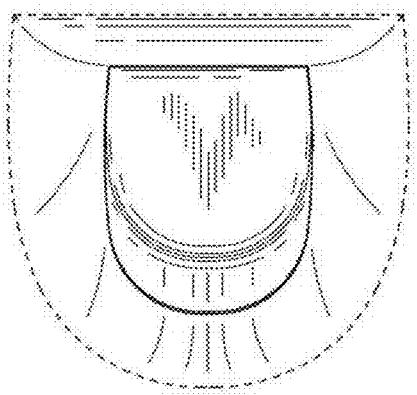
Figure 11A:
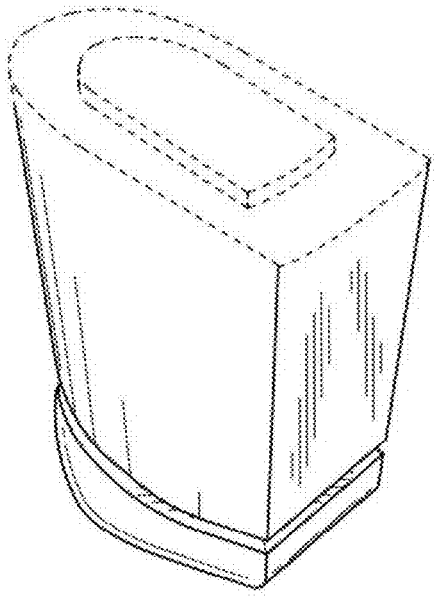
FIGS. 11A-E illustrate different views of an alternate embodiment of the suspension heel in accordance with aspects of the invention.
Figure 11B:
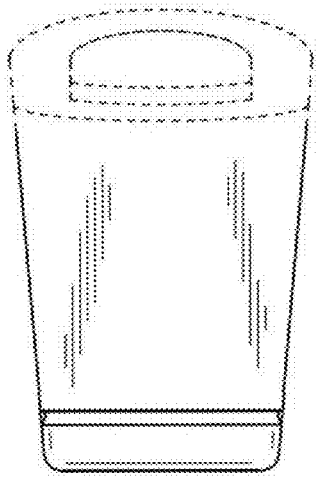
Figure 11C:
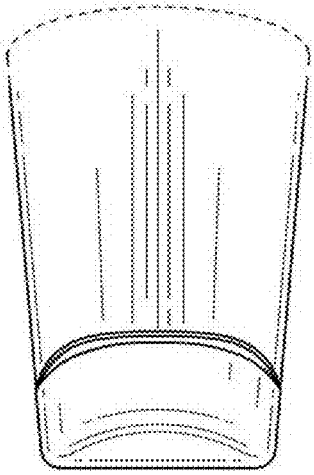
Figure 11D:
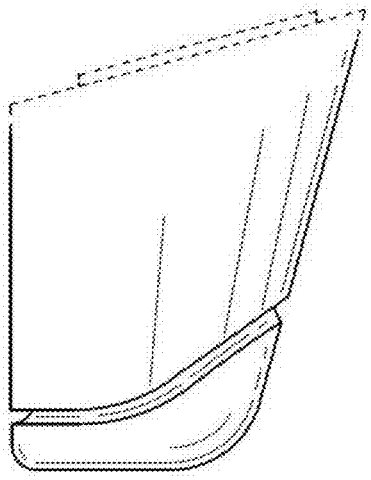
Figure 11E:
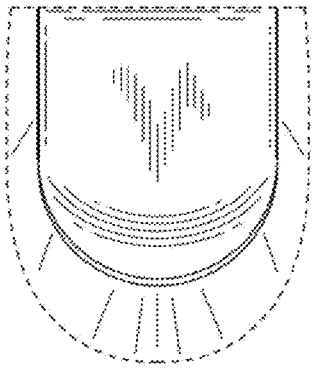

FIGS. 9A and 9B illustrate exemplary compression of relief detail spacing as a person is walking. For instance, as shown in FIG. 9A, the posterior region 30*a* (see FIG. 8) contacts the ground first, thereby causing compression of the relief detail spacing in that region. Then, as shown in FIG. 9B, as the forefoot section of the article of footwear comes into contract with the ground, the anterior region 30*b* (see FIG. 8) also contacts the ground, resulting in compression of the anterior relief detail spacing as well. Due to gait, weight and other factors, the compression may or may not be uniform around the heel member 14.

According to a further aspect of the invention, the relief detail RD may be positioned as close to the ground as possible. By locating the relief detail RD in this manner, there is a minimal effect on the shoe's aesthetics as compared to a traditional high-heeled shoe. Further, when walking, the initial application of force is normally introduced at the distal end of the heel. Attenuating this force at the point of contact reduces the length of the moment arm. Applying forces to a mechanism higher up the heel would lengthen the moment arm and magnify the force applied to the heel member. The increased lever action would induce more torque on the heel causing the heel to become unstable under the foot. The increased moment arm would act on the heel member-to-sole connection and is the reason that heel members are secured so tightly to the sole with the added requirement of a very stiff heel member made, e.g., from wood or plastic.

In one example, the relief detail $RD_{H1}$ (FIG. 7A) may be positioned on the order of 4-6 mm from the ground contacting base of the anterior region 30*b*. In other examples, the relief detail $RD_{H1}$ may be at least 2 mm or no more than 10 mm from the ground contacting base of the anterior region 30*b*. In contrast, the relief detail $RD_{H2}$ may be positioned on the order of 10-20 mm from the ground contacting base of the posterior region 30*a*. In other examples, the relief detail $RD_{H2}$ may be at least 7 mm or no more than 30 mm from the ground contacting base of the anterior region 30*b*. As shown in FIG. 7A, the position of the relief detail relative to the ground contacting surface may gradually increase from the anterior region 30*b* to the posterior region 30*a*.

FIGS. 10A-E illustrate different views of an exemplary embodiment of the suspension heel in accordance with aspects of the invention. FIGS. 11A-E illustrate different views of an alternative exemplary embodiment of the suspension heel in accordance with aspects of the invention. Broken lines in FIGS. 10A-E and 11A-E indicate an upper portion of the suspension heel that is affixable to the sole of a shoe.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An article of footwear, comprising:

a sole having a first surface for supporting a wearer's foot and a second surface remote from the first surface;

an upper connected to the sole; and a suspension heel member, the suspension heel member including:

a heel shaft having a first end connected to the second surface of the sole, and a second distal end remote from the first end, the distal end of the heel shaft having a heel cavity therein, and a compressible compliant heel plug having a base section for contacting the ground and a connecting section attached to the base section and fitting within the cavity of the distal end of the heel shaft, a region between the base section of the compressible compliant heel plug and the distal end of the heel shaft forming a relief detail there between, the relief detail configured to vary between a first size and a second reduced size to provide force attenuation to the wearer, wherein the connecting section of the compliant heel plug has an exterior surface and the heel cavity has one or more interior sidewalls, a first part of the connecting section of the compliant heel plug being rigidly affixed to the one or more interior sidewalls of the heel cavity such that the first part of the connecting section is immobile relative to the one or more interior sidewalls.

2. The article of footwear of claim 1, wherein the base section of the compliant heel plug includes anterior, posterior, medial and lateral regions, and the posterior region includes a curved surface with a predefined radius configured to enable a rolling action when contacting the ground during use of the article of footwear.

3. The article of footwear of claim 2, wherein the predefined radius of the curved surface of the posterior region of the base section of the compliant heel plug is between about 5-15 mm.

4. The article of footwear of claim 1, wherein the base section of the compliant heel plug includes anterior, posterior, medial and lateral regions, and the medial and lateral regions each include a curved surface with a predefined radius.

5. The article of footwear of claim 1, wherein the heel cavity has interior sidewalls and an end surface, and the heel shaft has one or more open regions therein extending within the heel shaft to the end surface of the heel cavity.

6. The article of footwear of claim 5, wherein a given one of the one or more open regions has a diameter between about 5-10 mm.

7. The article of footwear of claim 1, wherein the connecting section of the compliant heel plug has at least one open region therein.

8. The article of footwear of claim 1, wherein the exterior surface of the connecting section tapers at an angle from the base section of the compliant heel plug toward the heel cavity for contacting the one or more interior sidewalls.

9. The article of footwear of claim 8, wherein the tapered exterior surface of the connecting section of the compliant heel plug is frustoconical.

10. The article of footwear of claim 8, wherein the tapered exterior surface of the connecting section of the compliant heel plug is pyramidal.

11. The article of footwear of claim 8, wherein the exterior surface of the connecting section of the compliant heel plug tapers at an angle between about 1-10 degrees.

12. The article of footwear of claim 1, wherein the first part of the connecting section of the compliant heel plug is adhesively affixed to the one or more interior sidewalls of the heel cavity.

13. The article of footwear of claim 1, wherein a size of the relief detail is configured to decrease by at least 20 percent upon application of force to the compliant heel plug or the upper.

14. The article of footwear of claim 1, wherein the relief detail has an anterior section, a posterior section, a medial section and a lateral section, and the anterior section and posterior section of the relief detail are equal in size in an uncompressed state.

15. The article of footwear of claim 1, wherein the relief detail has an anterior section, a posterior section, a medial section and a lateral section, and the medial section and lateral section of the relief detail are equal in size in an uncompressed state.

16. The article of footwear of claim 1, wherein the relief detail has an anterior section and a posterior section, the anterior section of the relief detail is positioned between about 4-6 mm from the ground contacting base section of the compliant heel plug and the posterior section of the relief detail is positioned between about 10-20 mm from the ground contacting base section of the compliant heel plug.

17. A suspension heel for use with a shoe, the suspension heel comprising:

a heel shaft having a first end and a second distal end remote from the first end, the first end being configured to affix to a sole portion of the shoe, and the distal end of the heel shaft having a heel cavity therein, the heel cavity having one or more interior sidewalls; and a compressible compliant heel plug having a base section for contacting the ground and a connecting section attached to the base section, the connecting section extending from the base section, a first part of the connecting section fitting within the heel cavity of the distal end of the heel shaft, the first part of the connecting section being rigidly affixed to the one or more interior sidewalls of the heel cavity, wherein the base section of the compressible compliant heel plug and the distal end of the heel shaft form a relief detail there between, exposing a second part of the connecting section, the relief detail being configured to provide force attenuation by decreasing in size by at least 20 percent due to flexing of one or both of the base section and at least a portion of the second part of the connecting section of the compliant heel plug exposed by the relief detail upon application of force to the upper or compliant heel plug.

18. The suspension heel of claim 17, wherein the base section of the compliant heel plug includes anterior, posterior, medial and lateral regions, and the posterior region includes a curved surface with a predefined radius configured to enable a rolling action when contacting the ground during use of the article of footwear.

19. The suspension heel of claim 17, wherein an exterior surface of the connecting section of the compliant heel plug tapers at an angle from the base section of the compliant heel plug toward the heel cavity.

20. The suspension heel of claim 17, wherein the relief detail entirely circumscribes the suspension heel.

21. The suspension heel of claim 17, wherein the relief detail partially circumscribes the suspension heel.

22. A method of assembling an article of footwear, comprising:

affixing an upper having a covering for receiving a foot to a first surface of a sole of the article of footwear;

affixing a first end of a heel shaft to a second surface of the sole of the article of footwear remote from the first surface of the sole, the heel shaft having a heel cavity in a distal end of the heel shaft remote from the first end and adapted to receive a compliant heel plug therein and the heel cavity having one or more interior sidewalls;

wherein the compliant heel plug has a base section for contacting the ground and a connecting section attached to the base section, the connecting section extending from the base section, a first part of the connecting section fitting within the heel cavity of the distal end of the heel shaft; and adherently affixing the first part of the connecting section of the compliant heel plug to the one or more interior sidewalls of the heel cavity;

wherein a relief detail is formed between the base section of the compliant heel plug and the distal end of the heel shaft, exposing a second part of the connecting section of the compliant heel plug, the relief detail at least partially circumscribing the heel shaft and being configured to decrease in size by at least 20 percent due to flexing of one or both of the base section and at least a portion of the second part of the connecting section of the compliant heel plug exposed by the relief detail upon the application of force to the upper or the compliant heel plug.

* * * * *